US005931383A

United States Patent [19]

Palmer et al.

[11] Patent Number: 5,931,383

[45] Date of Patent: Aug. 3, 1999

[54] SELF-ILLUMINATED DRINKING STRAW

[75] Inventors: William R. Palmer; Stephen L. Palmer, both of Cameron Park, Calif.

[73] Assignee: Omniglow Corp.

[21] Appl. No.: 09/017,992

[22] Filed: Feb. 3, 1998

[51] Int. Cl.[6] ..... A47G 21/18

[52] U.S. Cl. ..... 239/33

[58] Field of Search ..... 239/33; D7/42; 446/202; 362/34

[56] References Cited

U.S. PATENT DOCUMENTS

| | | | |
|---|---|---|---|
| 2,811,808 | 11/1957 | Briese | 239/33 X |
| 3,718,282 | 2/1973 | Pizzoferrato | 239/33 |
| 4,726,518 | 2/1988 | Martina et al. | 239/33 |
| 5,171,081 | 12/1992 | Pita et al. | 362/34 |
| 5,695,270 | 12/1997 | Collet | 362/34 |

FOREIGN PATENT DOCUMENTS

| | | | |
|---|---|---|---|
| 562883 | 12/1957 | Belgium | 239/33 |

*Primary Examiner*—Kevin Weldon
*Attorney, Agent, or Firm*—McHale & Slavin, PA

[57] ABSTRACT

The instant invention provides for illuminated drinking straws which employ chemiluminescent mixtures as lighting sources. The illuminated drinking straw may be used with either hot or cold beverage such as water, fruit juices, soft drinks, coffees and teas, milk products or alcoholic beverages. A new and exciting drinking straw for amusement purposes is intended.

24 Claims, 12 Drawing Sheets

Illuminated Drinking Straw

SELF-ILLUMINATED DRINKING STRAW

FIELD OF THE INVENTION

This invention is directed to the field of chemiluminescent devices and in particular to the manufacture of drinking straws which are illuminated by a chemiluminescent means.

BACKGROUND OF THE INVENTION

Chemiluminescent devices are non-incandescent products which produce light from a chemical mixture. A variety of chemiluminescent devices have been patented which may be classified as "novelty" devices. For example, U.S. Pat. Nos. 5,158,349 and 5,390,086 disclose inventions applicable to chemiluminescent illuminated necklaces, and U.S. Pat. No. 4,814,949 discloses a chemiluminescent device applicable to novelty glowing shapes.

The basic chemiluminescent process produces light when two chemical solutions are combined. The solutions are kept physically separated prior to activation. Typically a sealed frangible glass vial containing a first solution is housed in a second flexible vessel which contains a second solution. This second vessel is sealed to contain both the second solution and the frangible vial. When the container is flexed, forces created by intimate contact with the internal vial cause the vial to rupture, thereby releasing the first solution. The first and second solutions mix and the reaction produces light. Since the object of these types of devices is to produce usable light output, the outer vessel is made of a clear or translucent material such as polyethylene or polypropylene which permits the light produced by the reaction to pass through the vessel walls. Chemiluminescent light may be generated in a variety of visible colors as well as non-visible infrared, which may be viewed through the use of special optical systems. One example of such a chemiluminescent system is taught in U.S. Pat. No. 5,043,851.

A commercially available chemiluminescent system to produce a yellow light is:

| Component | Weight Percent |
|---|---|
| Dibutyl Phthalate | 66.45% |
| Dimethyl Phthalate | 20.35% |
| CPPO* | 8.33% |
| T-butyl alcohol | 3.3% |
| 90% aq. Hydrogen Peroxide | 1.32% |
| CBPEA* | 0.23% |
| Sodium Salicylate | .0025% |
| Total | 99.98% |
| (apparent addition error result from rounding. | |

CPPO = bis(2,4,5-trichloro-6-carbopentoxyphenyl)oxalate
CBPEA = 1-chloro-9,10-bis(phenylethynyl)anthracene The chemical solutions in the aforementioned systems are generally referred to as the "oxalate" component and the "activator" component. The oxalate component in the above system would contain: Dibutyl Phthalate, CPPO and CBPEA. The activator solution in the above system would contain: Dimethyl Phthalate, T-butyl alcohol, 90% aq. Hydrogen Peroxide, Sodium Salicylate.

Other non-incandescent, chemical means of producing light which may be advantageously employed include bioluminescent systems, or alternately, chemiluminescent systems based on dioxetanes or other chemiluminescent reagents. Toy and novelty applications which utilizes bioluminescent systems are taught in PCT-WO 97/29319.

The instant invention is directed to the use of a chemiluminescent device in combination with a drinking straw. The unique lighting effects generated from chemiluminescent lighting devices are enhanced by the inherent optical properties of beverages. Beverage fluid motion, color, clarity and degree of effervescence, if any, all serve to add to the interest of the instant invention. While chemiluminescence has been employed to produce various forms of illuminated drinking vessels and novelty items such as "swizzle" sticks, heretofore no device has been produced which utilizes the intrinsically interesting nature of beverage fluid travel in transparent or partially transparent tubes or drinking straws.

Drinking straws have fascinated both children and adults in view of the beverage motion that occurs through the straws. Colorful stripes or spirals have been added to the outside of the drinking straws to further enhance this experience. Advertising or other indicia may be included in graphics which may be imprinted on the straw. Some drinking straws, rather than simply consisting of a straight tube are curved or bent. Indeed, drinking straws exist which are twisted into knots or elaborate three dimensional designs comprised of loops, spirals and the like. One company even offers a wearable drinking straw which resembles a pair of eyeglasses. Flexible plastic tubes connect one end of the "eyeglasses" to the user's mouth while a second flexible tube connected to the other end of the "eyeglasses" is placed in the beverage vessel. Sucking on the first flexible tube draws the beverage up the second flexible tube, through the "eyeglasses" and finally, through the first flexible tube into the user's mouth.

If the beverage is colored, as are many soft drinks, the effect of the beverage traveling through the plastic tubes is further enhanced. Many times beverages are served at restaurants, bars or house parties where the ambient light level is purposely reduced to enhance atmosphere. In these situations of reduced lighting many of the previously mentioned drinking straws lose their appeal. Firstly, the reduced lighting makes it difficult to see the presence of the beverage in the straw. Secondly, any decorative graphics such as stripes or spirals which may be imprinted on the straw become difficult to see in these reduced lighting environments.

A drinking straw that not only permitted visible movement of the beverage but also was self illuminating is clearly of interest. Indeed, not only can the beverage in the straw be illuminated by such a device but also any beverage in the cup, glass or other container in which the straw is placed. If the straw and the chemiluminescent lighting means are in relative close proximity, it is even possible to effect a color change in the apparent light produced by the device.

For example, if the chemiluminescent device is producing a generally green or yellow light and a red beverage is drawn up through the device, the red beverage can filter out certain spectral portions of the chemiluminescent light to produce an apparent color change. Some dyes or coloring agents can be used not only as color filters but as fluorescers. A fluorescent dye functions by converting light of one wavelength to another wavelength. For example, blue light from a chemiluminescent device might be converted to red light by employing an appropriate fluorescer. This red light could be produced even if there was little or no red light emitted by the chemiluminescent device. U.S. Pat. No. 4,379,320 teaches to the use of secondary fluorescers similar to those described above. Of course, if such dyes or fluorescers were to be incorporated into a beverage it is necessary that they be completely safe for consumption. A variety of fluorescent proteins exist which may be used in this application, the use of said proteins being taught in PCT-WO 97/29319.

Thus, what is lacking in the art is a novelty drinking straw which can be illuminated through chemiluminescent means.

SUMMARY OF THE INVENTION

The instant invention is an illuminated drinking straw providing a new class of chemiluminescent devices which are both novel and highly interesting. The illuminated drinking straws employ chemiluminescent means as lighting sources and may be used with either hot or cold beverages such as water, fruit juices, soft drinks, coffees and teas, milk products or alcoholic beverages. The lighting effects generated by a chemiluminescent illuminated drinking straw of the instant invention are further enhanced by the inherent optical properties of beverages. Beverage fluid motion, color, clarity and degree of effervescence, if any, all serve to add to the interest of the instant invention.

Accordingly, it is an objective of the instant invention to disclose the application of new and exciting drinking straws which are illuminated or partially illuminated through chemiluminescent means.

It is a further objective of this invention to disclose a variety of means of producing drinking straws which are illuminated by means of a chemiluminescent process.

Still another objective of the instant invention is to teach means whereby decorative indicia and/or advertising media on drinking straws may be enhanced by devices which are self-illuminating.

Yet still another objective of the instant invention is to provide for a drinking straw means in a manner which permits instant and easy activation of these chemiluminescent devices.

Other objectives and advantages of this invention will become apparent from the following descriptions taken in conjunction with the accompanying drawings wherein set forth, by way of illustration and example, are certain embodiments of this invention. The drawings constitute a part of this specification and include exemplary embodiments of the present invention and illustrate various objects and features thereof. It will be readily appreciated by those skilled in the art that the use of chemiluminescence to illuminate drinking straws will produce devices which are both novel and interesting.

DETAILED DISCLOSURE OF THE PREFERRED EMBODIMENTS

Although the invention has been described in specific embodiments, it will be readily apparent to those skilled in this art that various modifications, rearrangements and substitutions can be made without departing from the spirit of the invention. The scope of the invention is defined by the claims appended hereto.

Some basic requirements must be satisfied in each of the following embodiments to ensure that the devices described function safely and perform as desired. Firstly, the drinking straw portion of the device must by fabricated of materials which are safe for food contact and which are not degraded by this contact. Many plastics have been approved by the FDA for food contact. Most polyethylenes and polypropylenes are approved for use in food contact applications. Certain polystyrenes such as GPPS (General Purpose Polystyrene) are also often used for products which come into contact with food. PET (Polyethylene terephthlate) is widely used for food and beverage containers. Any of the aforementioned materials may be used for the drinking straw portion of the device. Materials other than aforementioned may be used so long as they are safe for food contact and possess processing properties suitable for formation of the item.

Secondly, the portion of the device which comes in contact with the chemiluminescent reagents must be chemically compatible with said reagents. Compatibility in this instance requires that the plastic or other materials used in the device which come into contact with the chemiluminescent reagents must not be significantly degraded by these reagents. Additionally, the plastic or other material chosen must not significantly interfere with chemical reagents or otherwise hinder the ability of the reagents to produce light by means of chemiluminescent reaction. If a plastic material is to come into contact with both the beverage product and the chemiluminescent reagents it must, of course, meet both sets of requirements detailed above.

Figure 1A:
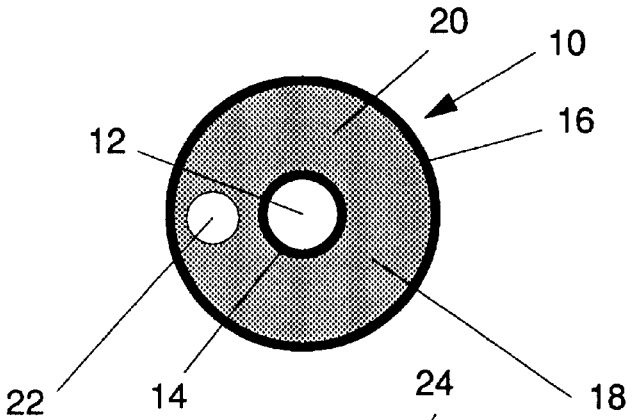
FIG. 1A is a cross sectional top view of FIG. 1.
Figure 1:
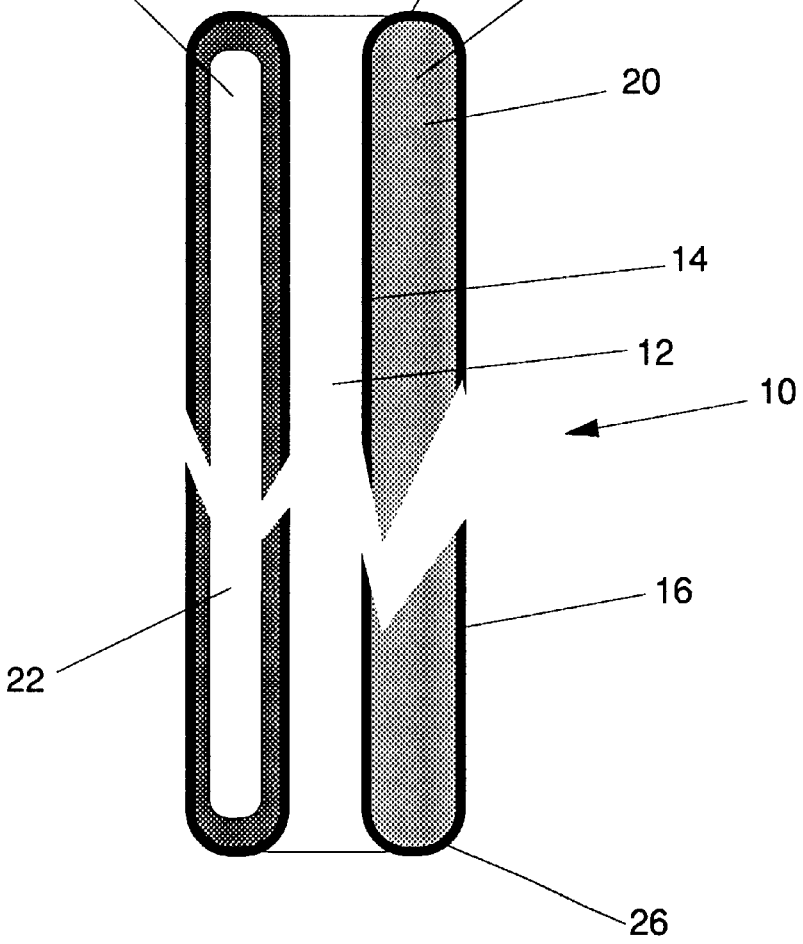
FIG. 1 is a cross sectional side view of an embodiment of the instant invention having an annular space for chemiluminescent reagents by placing a tube inside of a larger tube.

FIGS. 1 and 1A illustrate one embodiment 10 of the instant invention whereby an aperture 12 is created by use of tubular material 14 having a continuous side wall. The tubular material 14 is placed inside of a larger tube 16 forming an annular space 18, the annular space 18 contains a first chemiluminescent reagent 20 as well as a frangible vial 22 containing a second chemiluminescent reagent. The annular space 18 between the two coaxial tubes is sealed at both distal ends 24 and 26 so that said first chemiluminescent reagent 20 and said frangible vial 22 are completely contained. The interior space of the tube 14 is not sealed shut but is left open so as to permit beverages to be drawn up inside the aperture 12 when suction is applied to tube. The ends can be ultrasonic spin welded or heat sealed to close annulus ends. Activation of the chemiluminescent process is achieved by flexing the entire device 10 so that bending forces are transmitted to the frangible oxalate containing ampoule 22, thereby causing it to rupture. Subsequent mixing of the oxalate and activator reagents 20 generates light through the process of chemiluminescence.

Figure 2A:
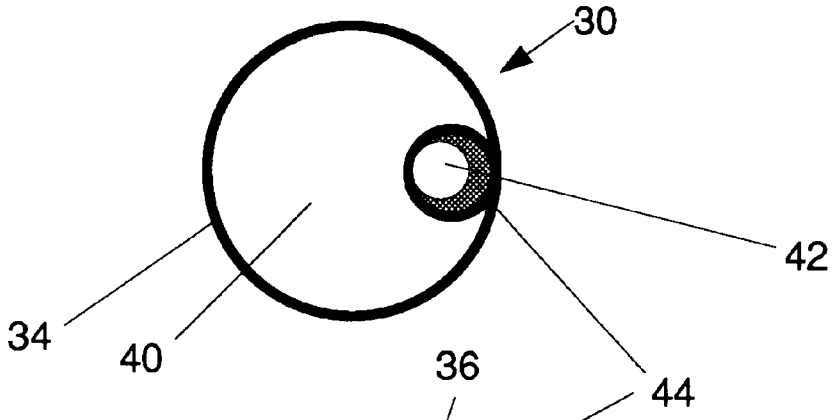
FIG. 2A is a cross sectional top view of FIG. 2.
Figure 2:
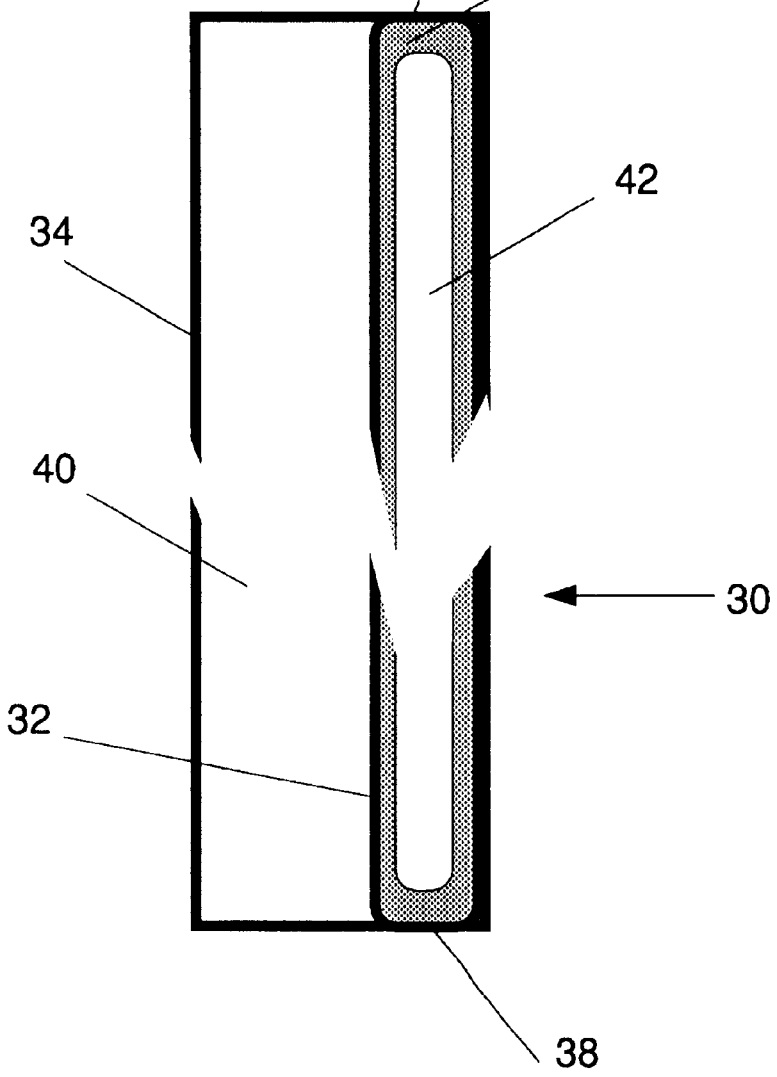
FIG. 2 is a cross sectional side view of another embodiment of the instant invention in which a single extruded plastic profile provides a tube for beverage passage and a second tube which contains the chemiluminescent reagents.

FIGS. 2 and 2A illustrate a drinking straw 30 in which a single extruded plastic profile provides both a first tube 32 which contains the chemiluminescent reagent 44 and a second tube 34 or lumen for beverage passage. The ends 36, 38 of the first tube 32 are hermetically sealed so that the chemiluminescent reagents are fully contained within the first tube. Since the drinking straw tube 34 with beverage flow channel 40 is extruded simultaneously with the profile tube, first tube 32, which will contain the chemiluminescent reagents, the two tubes may be joined continuously along their length. Additionally, simultaneous extrusion of these two tubes eliminates the need to position and assemble these tubes with respect to one another. Activation of the chemiluminescent process is achieved by flexing the entire device 30 so that bending forces are transmitted to the frangible oxalate containing ampoule 42, thereby causing it to rupture. Subsequent mixing of the oxalate and activator reagents 44 generates light through the process of chemiluminescence.

Figure 3A:
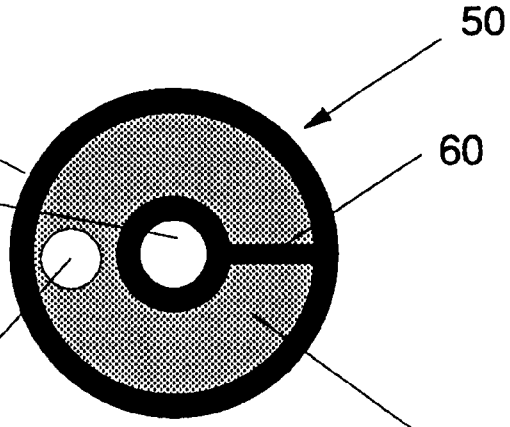
FIG. 3A is a cross sectional top view of FIG. 3.
Figure 3:
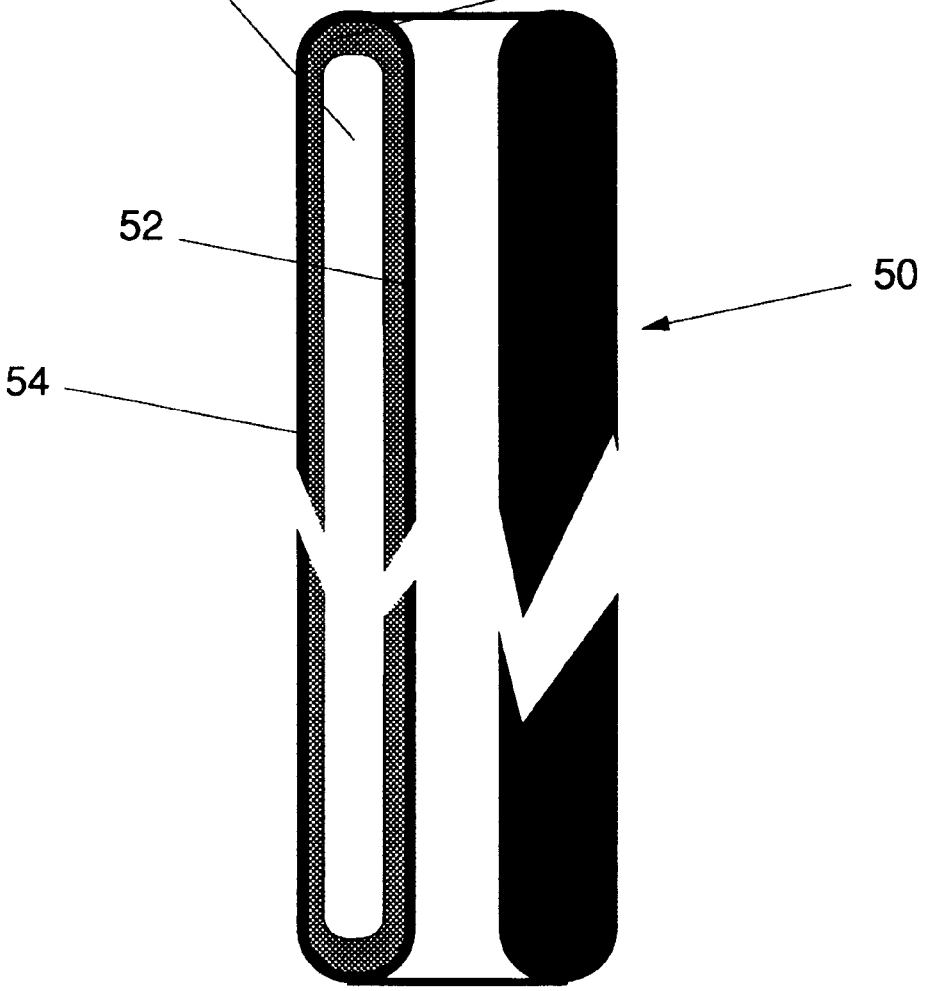
FIG. 3 is a cross sectional side view of another embodiment of the instant invention having a web to support an inner tube.

FIGS. 3 and 3A detail a drinking straw 50 whereby a first inner plastic tube 52 is supported inside a second plastic tube 54 having a larger diameter. The inner tube 52 permits the flow of beverage through it while the second tube 54 contains the chemiluminescent reagents 56 and oxalate 58. A web 60 connects the inner tube 52 and outer tube 54 and serves to maintain relative position of the tubes 52, 54. Both tubes 52, 54 and the web 60 may be extruded simultaneously as a single profile, thereby eliminating the need for placement and assembly of the two tubes. Activation of the chemiluminescent process is achieved by flexing the entire device 50 so that bending forces are transmitted to the frangible oxalate containing ampoule 58, thereby causing it to rupture. Subsequent mixing of the oxalate and activator reagents 56 generates light through the process of chemiluminescence. The inner tube 52 forms a beverage flow channel 62 for carrying of fluids.

Figure 4A:
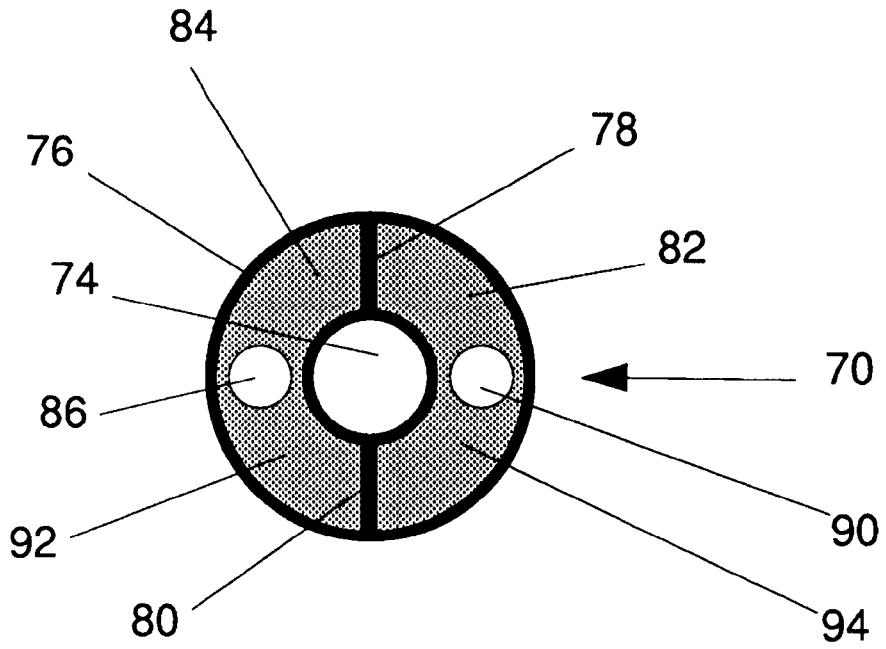
FIG. 4A is a cross sectional top view of FIG. 4.
Figure 4:
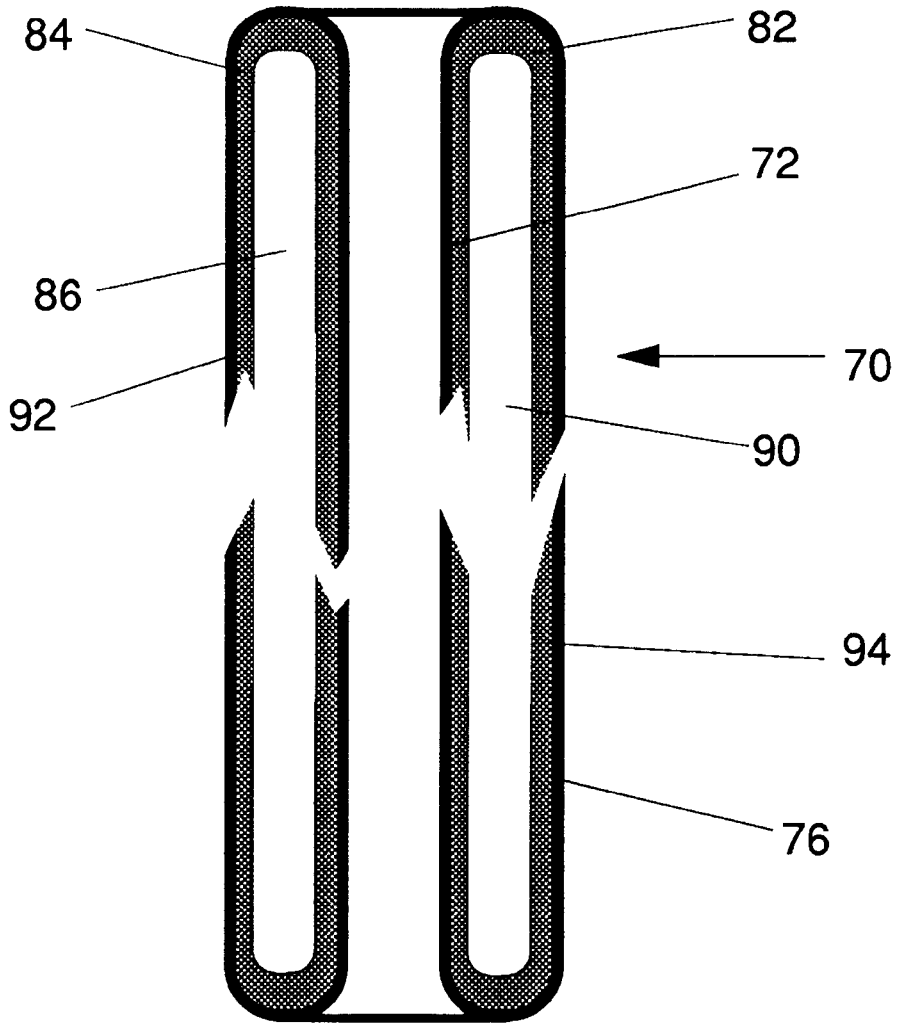
FIG. 4 is a cross sectional side view of another embodiment of the instant invention having separate channels.

FIGS. 4 and 4A are similar to the embodiment set forth in FIG. 3 above. In this embodiment, the drinking straw device 70 consists of a first tubular housing 72 forming the beverage flow channel 74. The first tubular housing 72 is placed within a second tubular housing 76 by the use of opposing webs 78 and 80 providing two separate channels 82 and 84 are provided for two separate chemiluminescent reagent systems. This design permits the use of two oxalate systems and hence a drinking straw which will emit two colors of light simultaneously. This light emission will appear as longitudinal stripes which stripes run along the sides of the straw. An oxalate ampoule 86 is disposed in channel 84 having activator reagent 92 further sealed therein. Similarly, an oxalate ampoule 90 of a different color is disposed in channel 82 having activator reagent 94 further sealed therein. Activation means is as described for the device in FIG. 1 and the previous embodiments.

Figure 5A:
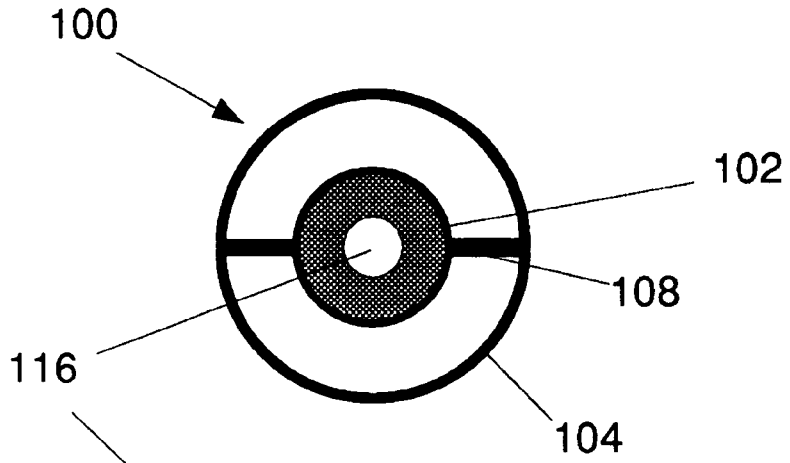
FIG. 5A is a cross sectional top view of FIG. 5.
Figure 5:
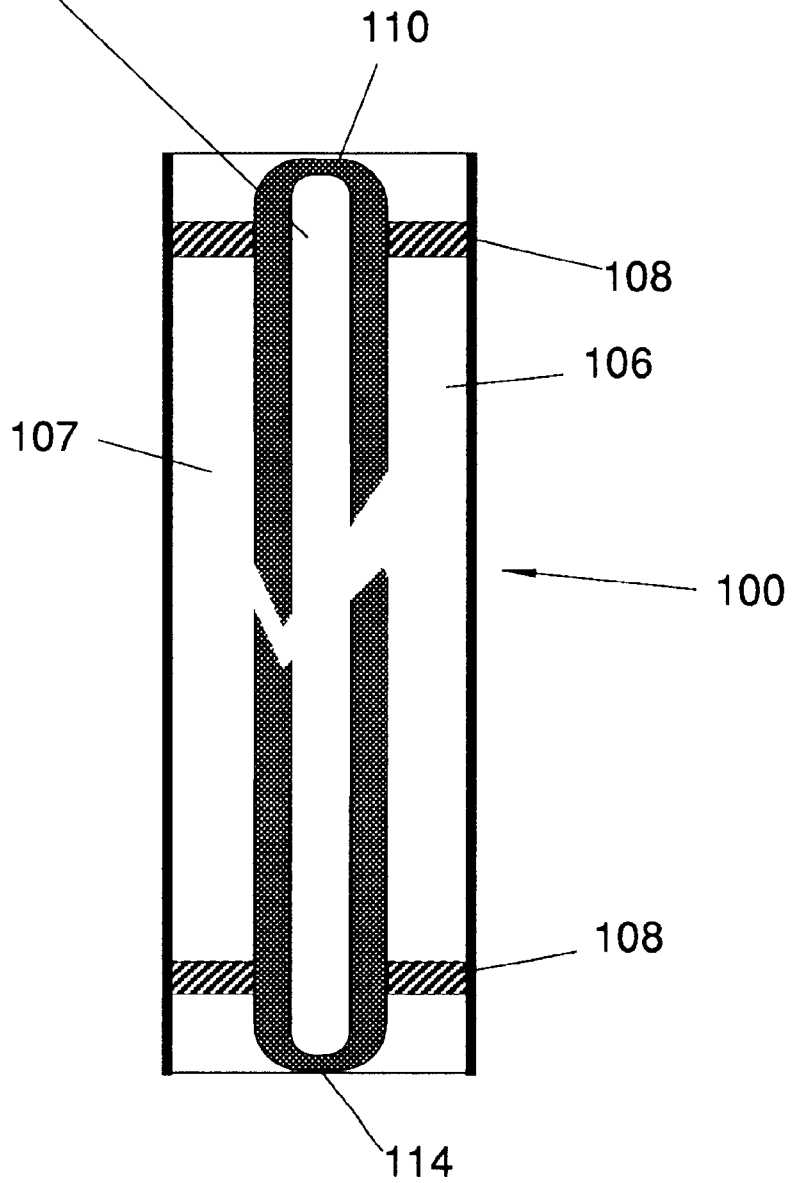
FIG. 5 is a cross sectional side view of another embodiment of the instant invention having beverage flow channels placed outside the chemiluminescent reagents.

FIGS. 5 and 5A illustrate a drinking straw 100 whereby the chemiluminescent reagents are contained in a single, sealed first tube 102 located internally and coaxially with respect to a second larger tube 104. The annular spaces 106 and 107 between the larger tube 104 and the inner reagent tube 102 serve as the beverage channel. Plastic webs 108 connect the first and second tubes 102, 104 to maintain their relative positions. One end 110 of the first tube 102 is sealed and the chemiluminescent reagents 112 are placed into this first tube. The other end 114 of the first tube 102 is sealed thereby providing for complete containment of the chemiluminescent reagents, including the oxalate ampoule 116. The second tube 104 is not sealed but remains open at both ends so that beverages may be drawn through it by suction means. Activation means is as described for the device in FIG. 1.

Figure 6A:
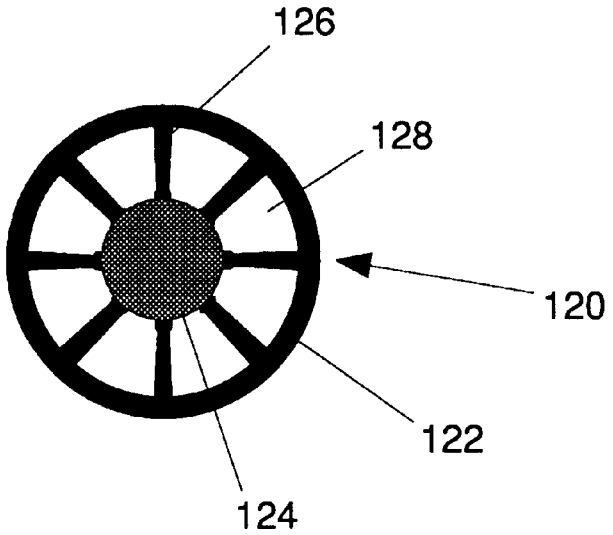
FIG. 6A is a cross sectional top view of FIG. 6.
Figure 6:
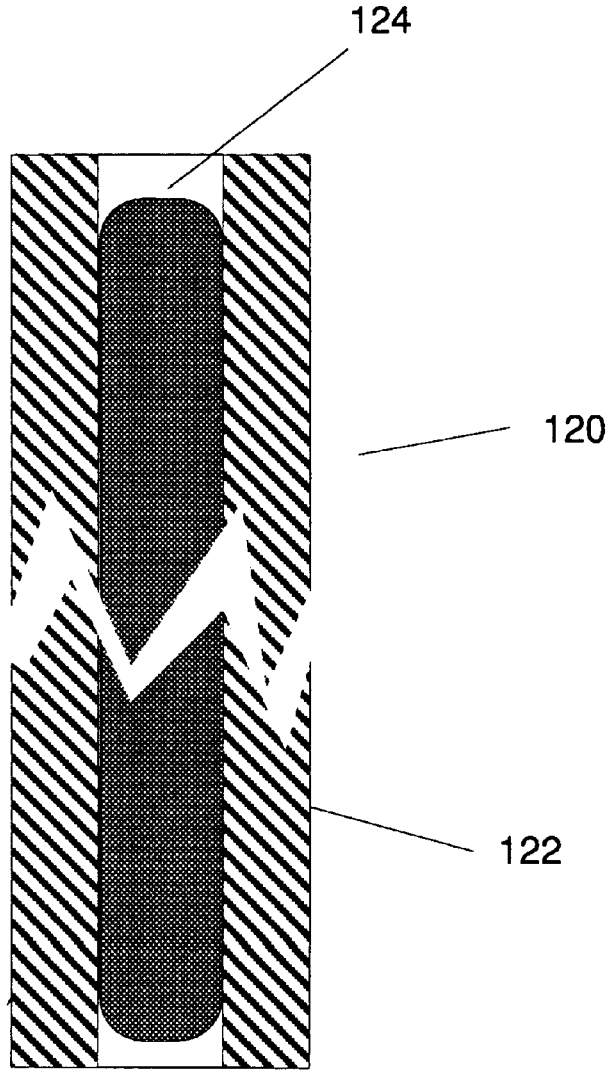
FIG. 6 is a cross sectional side view of another embodiment of the instant invention having a single plastic extrusion profile with a cylindrical chemiluminescent lighting element placed therein.

FIGS. 6 and 6A depict a drinking straw 120 whereby the chemiluminescent reagents are contained in a single plastic extrusion profile which may be used with a cylindrical chemiluminescent lighting element 124 to produce an illuminated drinking straw 120. The plastic extruded profile 122 has radially displaced, inwardly oriented fingers 126 which are designed to provide an interference fit with the outside diameter of a cylindrical, chemiluminescent lighting element 124. Said lighting element can be forcibly pushed into a length of the aforementioned extruded profile 122 whereby the lighting element 124 becomes more or less permanently affixed because of the interference fit between the outside diameter of the lighting element 124 and the fingers 126 on the extruded profile. Permanent attachment of the lighting element to the extruded profile can be achieved by the well known process of friction welding. If the lighting element 124 is inserted into the extruded profile 122 with sufficient speed and friction with respect to the extruded profile it will cause localized heating at the interface between the extruded profile and the lighting element, thereby melting and eventually fusing these two components. Rotation of the lighting element 124 relative to the extruded profile 122 can also be employed to facilitate a friction weld between the two components. Beverage flow is accommodated through the channels 128 between the outside diameter of the lighting element and the extruded profile. This embodiment has the advantage of utilizing standard chemiluminescent lighting elements which may be obtained "off-the-shelf" from manufacturers of chemiluminescent products. Activation means is as described for the device in FIG. 1.

Figure 7A:
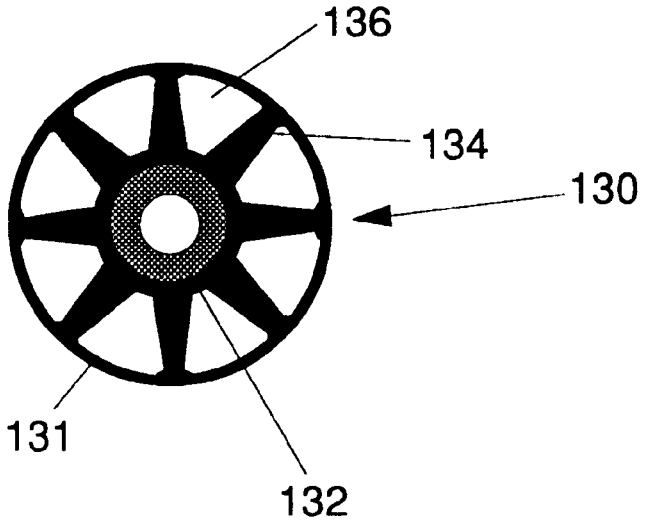
FIG. 7A is a cross sectional top view of FIG. 7.
Figure 7:
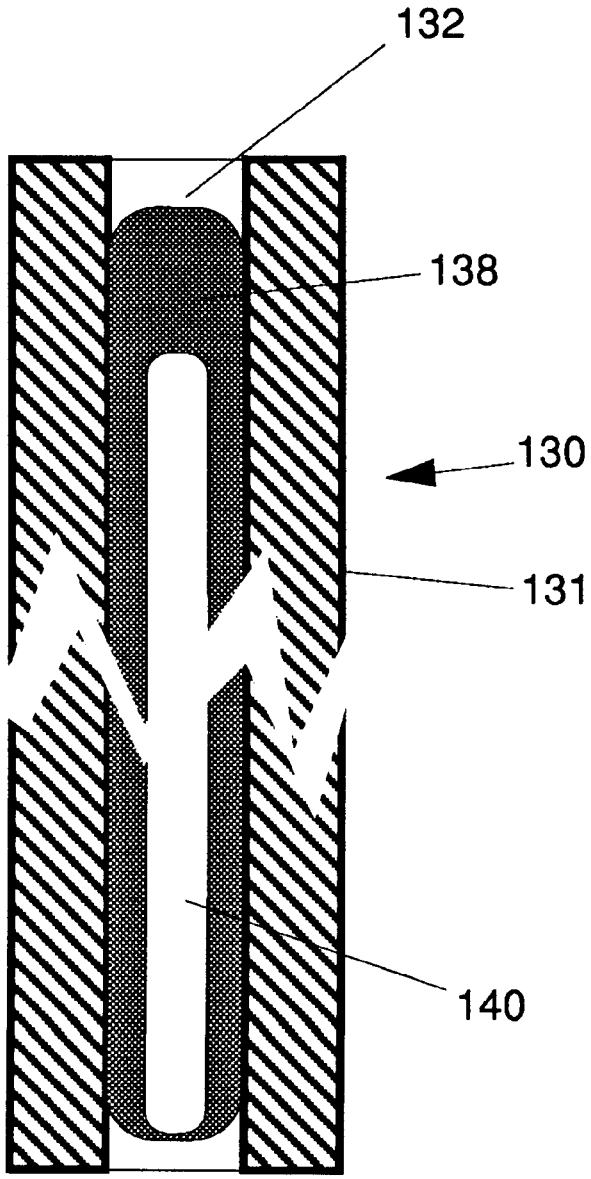
FIG. 7 is a cross sectional side view of another embodiment of the instant invention having a single plastic extrusion profile and integral radially displaced fingers with a cylindrical chemiluminescent lighting element placed therein.

FIGS. 7 and 7A illustrate a drinking straw 130 embodiment having a chemiluminescent lighting element 132 which is specially fabricated and incorporates integral, radially displaced fingers 134 or splines around its outside diameter. These splines 134 are designed to provide an interference or friction fit into a more or less smooth walled tube of specified diameter. The channels 136 formed between the splined chemiluminescent lighting element 132 and the inside wall of the smooth, outer tube 131 permit beverage flow. Friction welding of the lighting element 132 and the tube 131 may be employed as described above with respect to the embodiment shown in FIG. 6. Activation means is as described for the device in FIG. 1. The lighting element 132 houses the reagent 138 and oxalate ampoule 140.

Figure 8A:
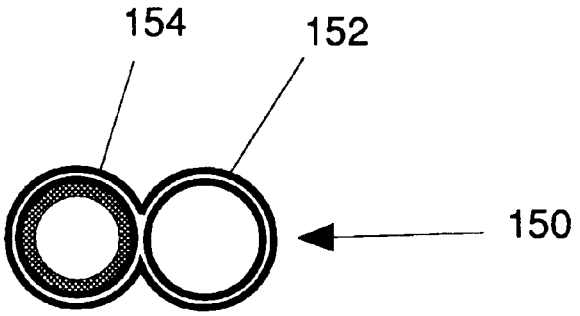
FIG. 8A is a cross sectional top view of FIG. 8.
Figure 8:
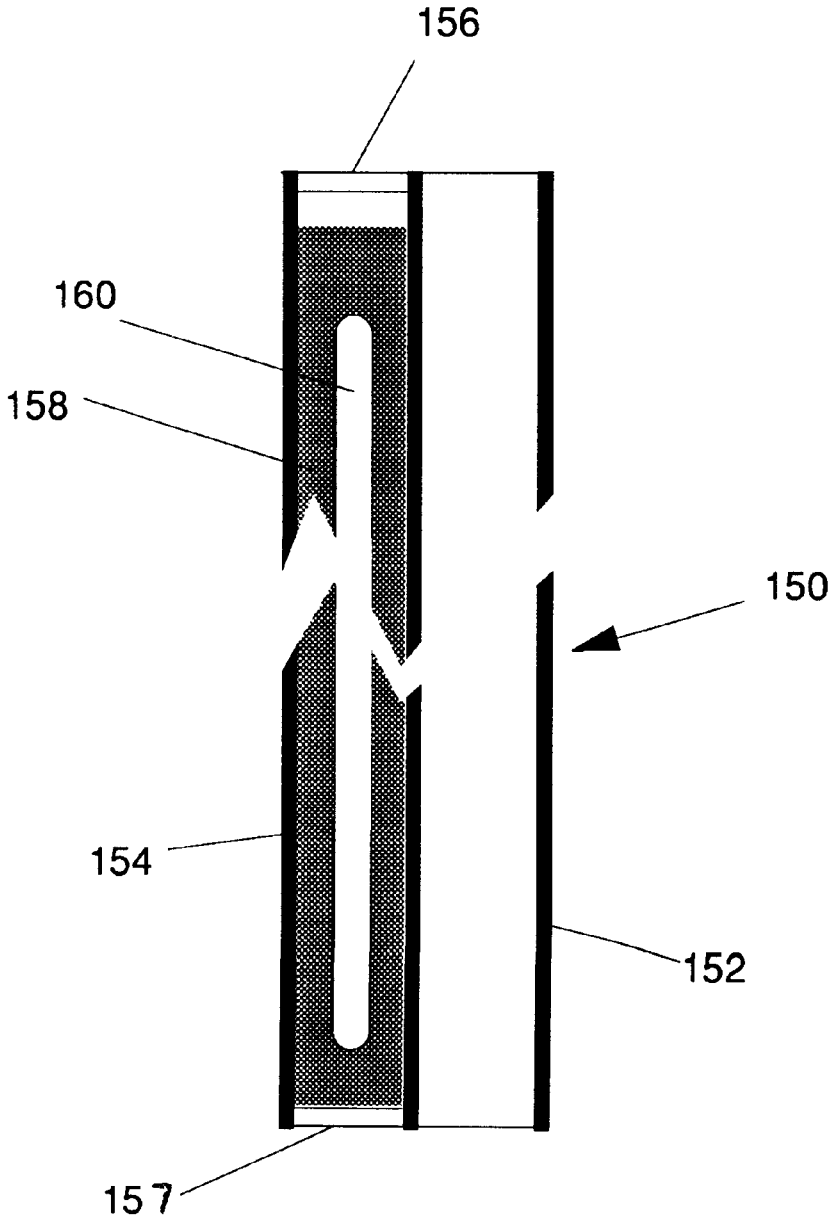
FIG. 8 is a cross sectional side view of another embodiment of the instant invention having a single plastic profile extrusion with two tubes joined in tandem.

FIGS. 8 and 8A illustrate an illuminated drinking straw 150 having a single profile extrusion. In this embodiment two tubes 152 and 154 are joined in tandem and continuously along their length. These tubes 152 and 154 may be produced in this joined together state by any of the well known means of thermoplastic extrusion. When the ends 156 and 157 of tube 154 are sealed, it functions as a sealed vessel to contain the chemiluminescent reagents, namely the activator reagent 158 and oxalate ampoule 160. The second tube 152 is left open at both ends and functions as a drinking straw. Since the two tubes are in close proximity and indeed share a portion of their respective walls, light produced from the first tube 154 which contains the chemiluminescent reagents will be readily transmitted to the second tube which serves as a conduit for beverage. The ends 156, 157 of the tube 154 containing the chemiluminescent reagents may be sealed by means of plugs which may be spin welded or ultrasonically welded in place. Alternately, the tube ends may be sealed by application of a heated die which melts, closes and seals the tube ends. Either the drinking straw tube or the tube containing the chemiluminescent reagents may be trimmed before, after or during the aforementioned sealing process as may be desired to achieve optimal form and function of the device. Activation means is as described for the device in FIG. 1.

Figure 9A:
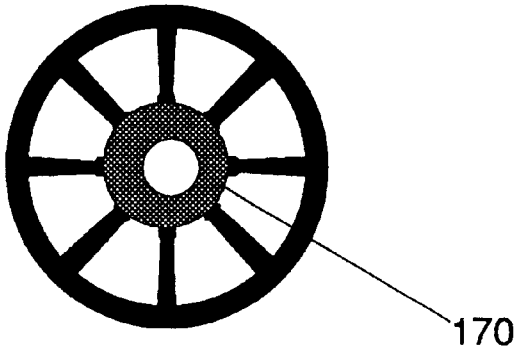
FIG. 9A is a cross sectional top view of FIG. 9.
Figure 9:
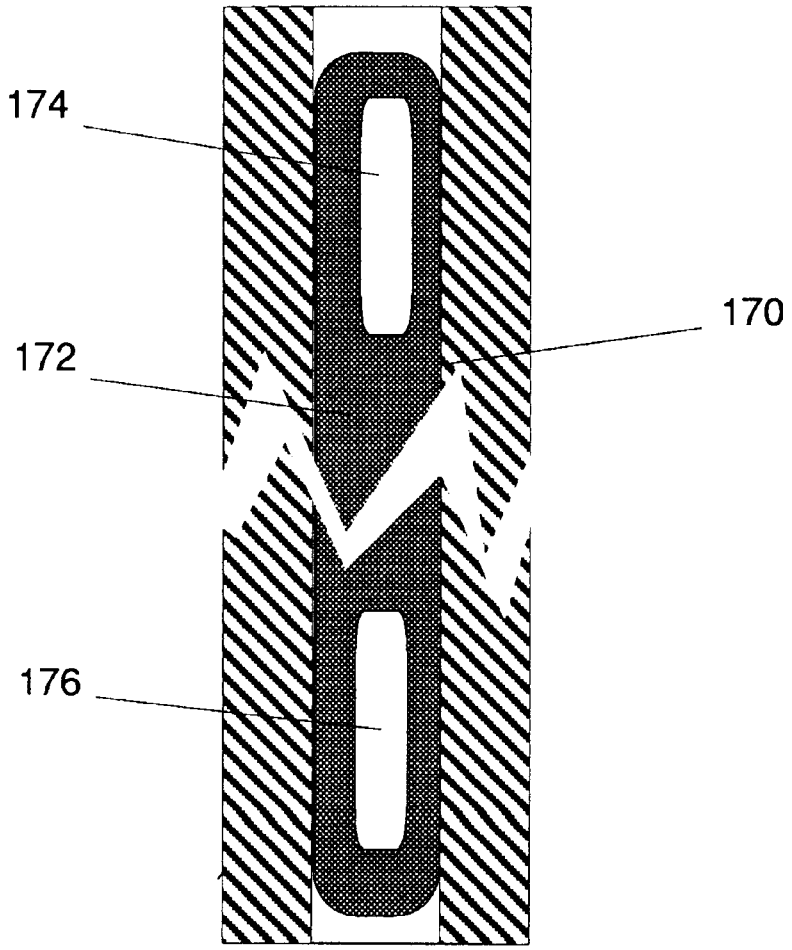
FIG. 9 is a cross sectional side view of another embodiment of the instant invention illustrating how lights of multiple color may be produced along the length of any of the aforementioned devices.

FIGS. 9 and 9A illustrate how lights of multiple colors may be produced along the length of any of the aforementioned devices. Two, three or any number of ampoules containing various colors of oxalate reagents may be "stacked" inside the tube which contains the activator reagent. In this example, the inner tube 170 includes the activator reagent 172 with red oxalate ampoule 174 and green oxalate ampoule 176. When activated, these different colored reagents are slow to mix owing to the relatively small diameter of the chemiluminescent reagent tube with respect to the length of the tube. Alternately the technique taught in U.S. Pat. No. 5,158,349, incorporated herein by reference, may be employed to maintain separation of the various oxalate colors. The friction welding method described above relating to the device illustrated in FIG. 6 may be employed to permanently attach the chemiluminescent lighting element to the extruded profile. Activation means is as described for the device in FIG. 1.

Figure 10:
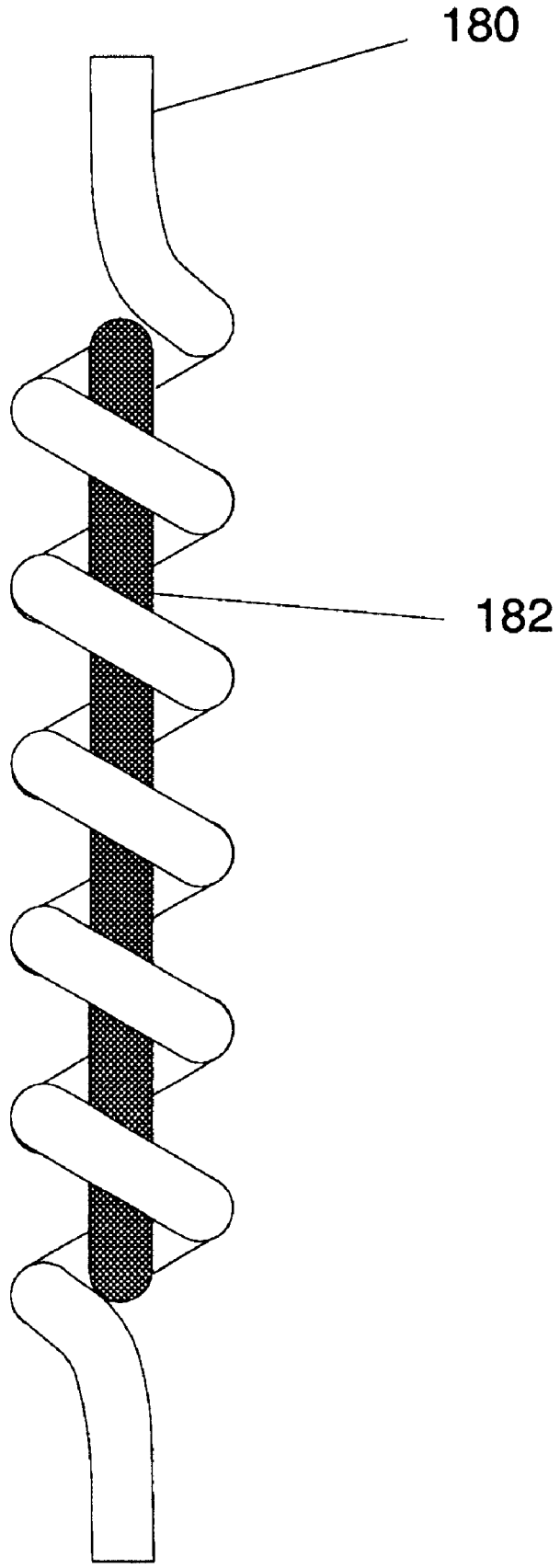
FIG. 10 is a cross sectional side view of another embodiment of the instant invention accommodating a chemiluminescent lighting element along its central axis.

FIG. 10 depicts a specially shaped drinking straw 180 which is designed to accommodate a chemiluminescent lighting element 182 along its central axis. The helical shape of the drinking straw 180 provides an interference fit on its interior for a chemiluminescent lighting element 182. The straw 180 may be fashioned in such a way that the removal of the chemiluminescent lighting element 182 is difficult or alternately, the device may be designed in such a manner that the chemiluminescent lighting element may easily be removed after exhaustion so that it may be replaced with another chemiluminescent lighting element. This replaceable lighting element 182 design also permits activation of the lighting element 182 prior to installation within the helical straw. The straw may also be designed so that the chemiluminescent lighting element is captured by the straw but is nevertheless loose and free to "rattle" around about the central axis of the straw. The single spiral helix shown in FIG. 10 is for illustrative purposes only. It is understood that the straw shape may in fact include an infinite variety of twists, turns, loops and so forth. Additionally, the lighting element may take on any form so long as it can be integrated with the drinking straw. Logos, signs or banners may be attached to either the straw or the lighting element as may be desired to provide for product brand identification, advertising or the like. Activation means is as described for the device in FIG. 1 except that in the case where the chemiluminescent lighting element is removable, said lighting element may be activated prior to placement within the drinking straw as may be desired.

Figure 11A:
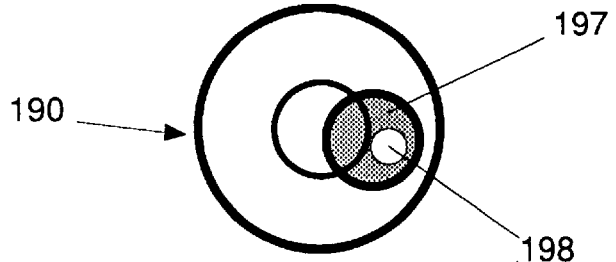
FIG. 11A is a cross sectional top view of FIG. 11.
Figure 11:
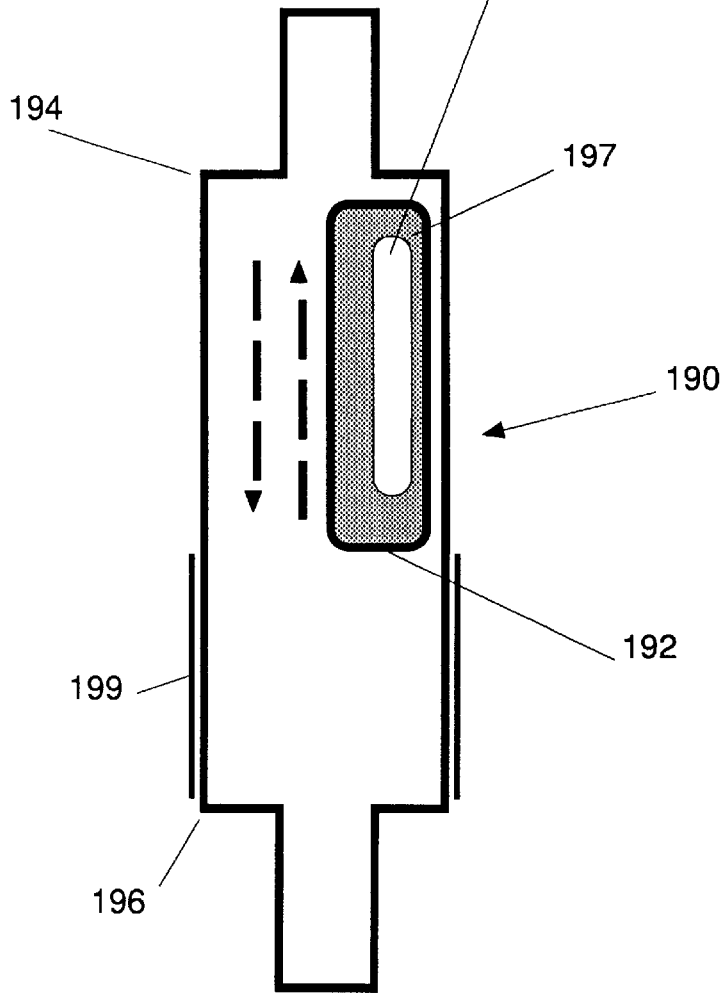
FIG. 11 is a cross sectional side view of another embodiment of the instant invention containing a movable chemiluminescent device.

FIGS. 11 and 11A illustrate a drinking straw 190 illuminated with a contained chemiluminescent device 192 which is movable with respect to the drinking straw. In this embodiment, both distal ends 194, 196 of the straw are fabricated with reduced inside diameters with respect to the central region of the straw. A chemiluminescent lighting element 192 is positioned within the inside diameter of the straw. The outside diameter of this chemiluminescent lighting element is necessarily smaller than the inside diameter of the central region of the straw so that the chemiluminescent lighting element is free to slide within the straw longitudinally. The ends 194 and 196 of the straw are of reduced diameters such that the chemiluminescent lighting element 192 is captivated within the straw body interior. When a first distal end 196 of the straw is positioned in a fluid such as a soft drink and a reduced pressure is applied to the second distal end 194 of the straw, fluid flow through the straw may be achieved. This fluid flow will then, if sufficient drag is produced on the chemiluminescent lighting element, cause the chemiluminescent lighting element to move in the general direction of the fluid flow until the chemiluminescent lighting element contacts the reduced diameter portion of the drinking straw or the fluid flow is reduced to a level insufficient to overcome the force acting on the chemiluminescent lighting element due to gravity. When such flow decreases, the chemiluminescent lighting element falls back to its original position. By controlling the fluid flow rate through the straw it is possible to position the movable chemiluminescent lighting element anywhere along its free path. Relative density of the chemiluminescent lighting element with respect to the fluid flowing in the straw will influence the final position of the lighting element in the straw at any given flow rate. A lighting element 192 with a specific gravity which is less than the fluid in the straw will necessarily be buoyed up by the fluid. The lighting element 192 has the activator reagent 197 and oxalate ampoule 198. A straw of varying internal cross section such as a conic section may be employed to yield a more or less calibrated flow meter whereby the beverage flow rate through the straw is indicated by the equilibration point of the chemiluminescent lighting element along the length of the straw. Graduations along the length of the straw would provide an indication of fluid flow which may be useful for beverage drinking contests or other games. Additionally, one or more colored filters 199 or secondary fluorescers may be positioned along the length of the straw to alter the color of the observed light produced by the chemiluminescent lighting element as it travels within the straw interior. It is of course understood that a plurality of chemiluminescent lighting elements may be situated within the drinking straw which elements may be either free to or restricted from bypassing one another by their size and/or geometry. The means illustrated in FIG. 11 to contain the chemiluminescent lighting element within the straw are illustrated as total straw diameter reductions. It is understood however that these containment means may consist of partial diametric reductions such as "dimples" or cross section reductions such as may be realized by bars, grids, screens or any other well known method to contain objects within a tube while permitting flow through said tube. Unless some form of maximum fluid flow shut off is desired, it is necessary to keep the movable chemiluminescent lighting element from sealing off the fluid flow in the straw which may occur if the lighting element becomes either temporarily or permanently lodged against the outlet end of the straw body tube. Small fingers or struts may be employed to hold off the lighting element from the tube outlet to ensure that the lighting element does not impede fluid flow. Longitudinally spiraled vanes on the outer surface of the chemiluminescent lighting element may be employed to impart a spinning action to the lighting element during fluid flow if desired.

Figures 12, 12A:
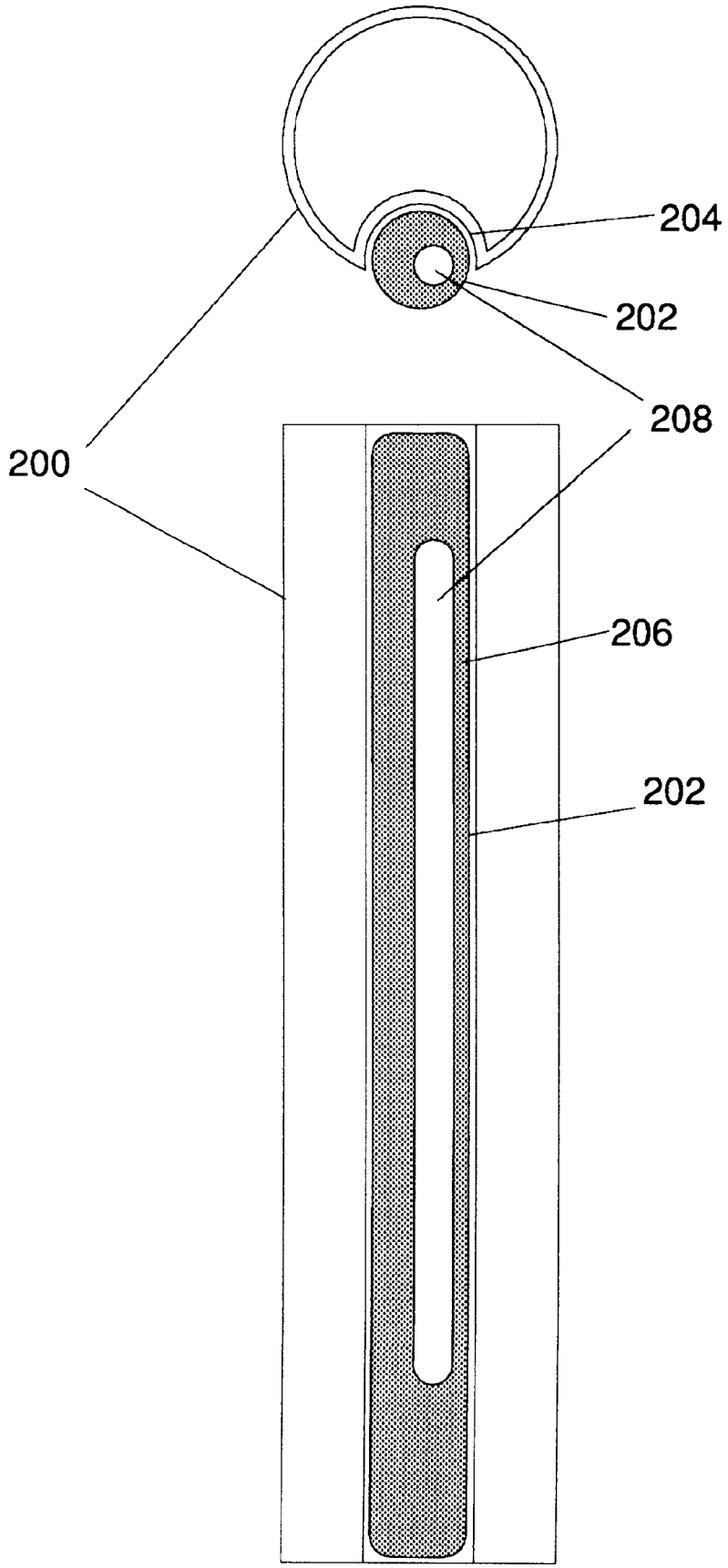
FIG. 12 is a cross sectional side view of another embodiment of the instant invention wherein a drinking straw may be fitted over a cylindrical chemiluminescent lighting device.
FIG. 12A is a cross sectional top view of FIG. 12.

FIGS. 12 and 12A illustrate a drinking straw 200 which may be fitted to a cylindrical chemiluminescent lighting device 202. This drinking straw 200 may be fabricated from a single extruded profile which has integral to it a more or less semi-circular groove 204. Said groove 204 being designed to snap over a cylindrical chemiluminescent lighting element. The lighting element may either be pushed into the semi-circular groove 204 in the straw profile longitudinally or alternately, the lighting element may be pressed into the groove from the side. The lighting element 202 has within it activator reagent 206 and oxalate ampoule 208.

All of the illuminated drinking straws described herein employ frangible containers to maintain separation of the chemiluminescent reagents prior to activation at which time, said frangible containers are ruptured and permit the two or more chemiluminescent reagents to mix and thereby produce chemiluminescent light. It is understood that the instant invention may also employ self activating chemiluminescent systems in which the chemiluminescent reagents which are normally kept separate prior to activation are, in this case, combined into one solution. No frangible ampoules are used. The chemical reagents immediately begin producing light when combined. Said light production is essentially stopped or at least greatly arrested by reducing the temperature of the reagent mixture. If devices containing these reagent mixtures are kept sufficiently cold, the devices may be stored many months or even years prior to thawing, light production and subsequent use. Any of the aforementioned devices may employ this self-activating design to eliminate the frangible ampoule. Products of such design must of course be stored and transported in a state of reduced temperature to maintain their effectiveness.

It is understood that the means of producing illuminated drinking straws employing chemiluminescence includes but is not limited to the specific materials and embodiments described herein and that other materials and manufacturing means exist to meet the requirements of such a system. Such additional means are within the scope of this patent. It is to be understood that while we have illustrated and described certain forms of the invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A chemiluminescent drinking straw comprising: a first tubular shaped member having a first end and a second end with a continuous side wall therebetween, said side wall forming an aperture for drawing fluids between said first and second end;

a second tubular shaped member juxtapositioned to said first tubular shaped member, said second tubular shaped member containing a chemiluminescent mixture;

whereby said first tubular shaped member may be used as a drinking straw and said chemiluminescent mixture provides lighting effects that are enhanced by the inherent optical properties of the fluids.

2. The chemiluminescent device according to claim 1 wherein said second tubular tube is hermetically sealed with said chemiluminescent mixture sealed therein.

3. The chemiluminescent device according to claim 1 wherein said chemiluminescent mixture is an activator reagent and an oxalate reagent.

4. The chemiluminescent device according to claim 3 including a means for separating said activator reagent and said oxalate reagent.

5. The chemiluminescent device according to claim 4 wherein said means for separating is placement of one of said reagents within a frangible vial.

6. The chemiluminescent device according to claim 1 wherein said first tubular shaped member is placed within said second tubular shaped member.

7. The chemiluminescent device according to claim 6 wherein said first tubular shaped member is centrally disposed within said second tubular shaped member.

8. The chemiluminescent device according to claim 7 wherein said first tubular shaped member is maintained in said centrally disposed position by use of a web member coupling said first tubular shaped member to said second tubular shaped member.

9. The chemiluminescent device according to claim 1 wherein said device has a single extruded plastic profile.

10. The chemiluminescent device according to claim 1 wherein said second tubular shaped member houses separate chemiluminescent reagents providing independent colors.

11. The chemiluminescent device according to claim 1 wherein said second tubular shaped member is placed within said first tubular shaped member.

12. The chemiluminescent device according to claim 11 wherein said second tubular shaped member is centrally disposed within said first tubular shaped member.

13. The chemiluminescent device according to claim 11 wherein said first tubular shaped member is further defined as a plastic extruded profile having radially displaced, inwardly oriented fingers to provide an interference fit with an outer diameter of said first tubular shaped member.

14. The chemiluminescent device according to claim 13 wherein said radially displaced, inwardly oriented fingers form an integral support tube.

15. The chemiluminescent device according to claim 1 wherein said first and second tubular shaped member are joined in tandem and continuously along their length.

16. The chemiluminescent device according to claim 3 wherein said chemiluminescent mixture includes an activator reagent and multiple oxalate ampoules.

17. The chemiluminescent device according to claim 6 wherein said first tubular shaped member is helically shaped.

18. The chemiluminescent device according to claim 1 wherein said second tubular shaped member is movable within said first tubular shaped member.

19. The chemiluminescent device according to claim 18 wherein said second tubular shaped member and said chemiluminescent mixture placed therein have a combined specific gravity less than the fluids drawn through said straw.

20. The chemiluminescent device according to claim 1 including a color filter.

21. The chemiluminescent device according to claim 1 including an external fluorescer.

22. The chemiluminescent device according to claim 1 wherein said first tubular shaped member includes indicia.

23. The chemiluminescent device according to claim 1 wherein said second tubular shaped member includes indicia.

24. The chemiluminescent device according to claim 1 wherein said first tubular shaped member has an extruded profile which has integral to it a groove for frictional engagement of said second tubular shaped member.

* * * * *